US009205444B2

(12) United States Patent
Bhattacharya

(10) Patent No.: US 9,205,444 B2
(45) Date of Patent: Dec. 8, 2015

(54) INTELLIGENT AIR CONDITIONING SYSTEM FOR A PAINT BOOTH

(71) Applicant: Shubho Bhattacharya, Dublin, OH (US)

(72) Inventor: Shubho Bhattacharya, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 359 days.

(21) Appl. No.: 13/777,491

(22) Filed: Feb. 26, 2013

(65) Prior Publication Data

US 2013/0171920 A1 Jul. 4, 2013

Related U.S. Application Data

(63) Continuation of application No. 11/762,413, filed on Jun. 13, 2007, now abandoned.

(51) Int. Cl.

| | |
|---|---|
| ***B05B 15/12*** | (2006.01) |
| ***F24F 11/00*** | (2006.01) |
| ***B05B 12/08*** | (2006.01) |

(52) U.S. Cl.

CPC ..... *B05B 15/1222* (2013.01); *B05B 12/08* (2013.01); *F24F 11/0008* (2013.01)

(58) Field of Classification Search

CPC ..... B05B 15/1222; F24F 11/0008; F24F 11/0015

USPC ..... 62/176.5, 176.6; 236/44 C

See application file for complete search history.

(56) References Cited

U.S. PATENT DOCUMENTS

| | | | |
|---|---|---|---|
| 2,946,943 | A | 2/1956 | Nye et al. |
| 3,617,717 | A | 11/1971 | Smith |
| 4,173,924 | A | 11/1979 | Bradshaw |
| 4,367,787 | A | 1/1983 | Bradshaw |
| 4,404,451 | A | 9/1983 | Niikawa et al. |
| 4,430,698 | A | 2/1984 | Harris |
| 4,494,596 | A | 1/1985 | Bradshaw |
| 4,542,851 | A | 9/1985 | Itou |

(Continued)

FOREIGN PATENT DOCUMENTS

| | | |
|---|---|---|
| JP | 9-38546 | 2/1997 |
| JP | 09038546 | 2/1997 |

(Continued)

OTHER PUBLICATIONS

Office Action from U.S. Appl. No. 12/820,826 dated May 10, 2013.

(Continued)

*Primary Examiner* — Marc Norman

(74) *Attorney, Agent, or Firm* — Rankin, Hill & Clark LLP

(57) ABSTRACT

A conditioning system that conditions exterior air for use in a spray booth. The exterior air is conditioned and subsequently used to carry away coating mist, dust, and contaminants from a spray area. The conditioning system heats, cools, humidifies, and dehumidifies the exterior air to a variable set point. The variable set point, while bounded by dry-bulb temperature and relative humidity constraints, is selected based upon cost and/or energy minimization. Additionally, the set point selection may be based upon future predicted weather conditions that are determined with a mathematical profile of previous weather conditions and weather trends in a localized domain, where the localized domain is a geographic area surrounding a manufacturing plant that includes a spray booth.

21 Claims, 9 Drawing Sheets

(56) References Cited

U.S. PATENT DOCUMENTS

| | | | |
|---|---|---|---|
| 4,687,686 | A | 8/1987 | Stofleth et al. |
| 4,729,294 | A | 3/1988 | Osawa et al. |
| 4,730,553 | A | 3/1988 | Osawa et al. |
| 4,731,547 | A | 3/1988 | Alenduff et al. |
| 4,795,088 | A | 1/1989 | Kobayashi et al. |
| 4,943,003 | A | 7/1990 | Shimizu et al. |
| 4,991,770 | A | 2/1991 | Bird et al. |
| 5,127,574 | A | 7/1992 | Mosser et al. |
| 5,173,118 | A | 12/1992 | Josefsson |
| 5,213,259 | A | 5/1993 | Stouffer |
| 5,264,014 | A | 11/1993 | Lannefors et al. |
| 5,270,952 | A | 12/1993 | Adams et al. |
| 5,301,101 | A | 4/1994 | MacArthur et al. |
| 5,346,128 | A | 9/1994 | Wacker |
| 5,408,838 | A | 4/1995 | Yaeger et al. |
| 5,460,569 | A | 10/1995 | Josefsson |
| 5,554,416 | A | 9/1996 | Scheufler et al. |
| 5,573,181 | A | 11/1996 | Ahmed |
| 5,618,333 | A | 4/1997 | Buchholz et al. |
| 5,746,650 | A | 5/1998 | Johnson et al. |
| 5,819,845 | A | 10/1998 | Ryu et al. |
| 5,915,473 | A | 6/1999 | Ganesh et al. |
| 5,924,486 | A | 7/1999 | Ehlers et al. |
| 6,010,562 | A | 1/2000 | Flynn et al. |
| 6,129,285 | A | 10/2000 | Schafka |
| 6,240,324 | B1 | 5/2001 | Preska et al. |
| 6,253,113 | B1 | 6/2001 | Lu |
| 6,264,111 | B1 | 7/2001 | Nicolson et al. |
| 6,269,274 | B1 | 7/2001 | Steinman et al. |
| 6,502,629 | B2 | 1/2003 | Valachovic |
| 6,508,303 | B1 | 1/2003 | Naderer |
| 6,825,631 | B1 | 11/2004 | Nakamura |
| 6,829,522 | B1 | 12/2004 | Filev et al. |
| 6,926,079 | B2 | 8/2005 | Kensok et al. |
| 7,059,536 | B2 | 6/2006 | Schneider et al. |
| 7,155,318 | B2 | 12/2006 | Sharma et al. |
| 7,310,572 | B2 | 12/2007 | Havlena et al. |
| 7,346,467 | B2 | 3/2008 | Bohrer et al. |
| 7,360,534 | B2 | 4/2008 | Krupp |
| 7,389,813 | B2 | 6/2008 | Babikian et al. |
| 2004/0215356 | A1 | 10/2004 | Salsbury et al. |
| 2007/0066203 | A1 | 3/2007 | Melegatti |
| 2007/0093193 | A1 * | 4/2007 | Cook et al. ..... 454/52 |
| 2008/0071395 | A1 | 3/2008 | Pachner |
| 2008/0082312 | A1 | 4/2008 | Dash et al. |
| 2008/0134098 | A1 | 6/2008 | Hoglund et al. |
| 2008/0184991 | A1 | 8/2008 | Krupp |
| 2008/0311836 | A1 | 12/2008 | Bhattacharya |
| 2009/0109056 | A1 | 4/2009 | Tamarkin et al. |
| 2009/0130317 | A1 | 5/2009 | Moore |
| 2009/0210094 | A1 | 8/2009 | Boder et al. |
| 2010/0070093 | A1 | 3/2010 | Harrod et al. |
| 2011/0311929 | A1 | 12/2011 | Moran et al. |

FOREIGN PATENT DOCUMENTS

| | | |
|---|---|---|
| JP | 11-101485 | 4/1999 |
| JP | 11101485 | 4/1999 |
| JP | 2000-310440 | 11/2000 |
| JP | 2000310440 | 11/2000 |
| JP | 2003-50038 | 2/2003 |
| JP | 2003050038 | 2/2003 |
| KR | 10-2006-0000653 | 1/2006 |
| KR | 1020060000653 | 1/2006 |
| KR | 10-0657431 | 12/2006 |
| KR | 100657431 | 12/2006 |

OTHER PUBLICATIONS

Honeywell, Specification, UDC 3300 Universal Digital Controller, 1999, 1 page, Industrial Automation and Control, Fort Washington, PA.

Honeywell, Product Information Note, Profit Controller Multivariable Control and Optimization Technology, Jul. 2007, 3 pages, Automation & Control Solutions, Phoenix, AZ.

UK Patent Search Report of Application No. GB0810422.6 dated Sep. 3, 2008.

UK Patent Search Report of Application No. GB0911024.8 dated Sep. 11, 2009.

Combined Search and Examination Report of UK Application No. GB0922458.5 dated Oct. 11, 2010.

U.S. Appl. No. 12/820,826, filed Jun. 22, 2010 and entitled "Cascading Set Point Burner Control System for Paint Spray Booths".

Office Action of U.S. Appl. No. 11/762,413 dated Jul. 6, 2011.

Office Action of U.S. Appl. No. 11/762,413 dated Oct. 26, 2012.

Honeywell, Specification, UDC 3300 Universal Digital Controller, Industrial Automation and Control, 1110 Virginia Drive, Fort Washington, PA 19034, 1999.

Honeywell, Product Information Note, Profit Controller Multivariable Control and Optimization Technology, Automation & Control Solutions, Jul. 2007.

* cited by examiner

INTELLIGENT AIR CONDITIONING SYSTEM FOR A PAINT BOOTH

This application is a continuation of application Ser. No. 11/762,413, filed Jun. 13, 2007, the entirety of which is incorporated by reference herein.

BACKGROUND OF THE INVENTION

1. Field of the Invention

The present invention is generally directed toward paint booth air handling systems and, more particularly toward a method for conditioning exterior air for use in a paint booth.

2. Description of Related Art

In a spray booth for painting, for example, vehicle bodies that are continuously conveyed on a conveyor through the spray booth, the quality of the conditioned (booth ambient) air is very important. Typically, exterior (atmospheric) air is passed through a conditioning area prior to being sent into the spray booth. The conditioned air is directed by an intake fan to a plenum chamber and is discharged downwardly at a predetermined flow velocity into the spray booth. The conditioned air in the spray booth is drawn together with coating mists, including any evaporated organic solvents, and is discharged beneath the booth by an exhaust fan. This downward air flow can prevent the coating mist or dust, which would otherwise create quality defects on the vehicle paint surface, from scattering and drifting in the booth. The airflow also helps provide a safer working environment for operators in the spray booth.

To properly treat the exterior air, known spray booth systems pass exterior air through the conditioning area to adjust properties of the exterior air. The conditioning area includes filters to remove dust or contaminants, preheaters and reheaters to warm, humidifiers to humidify and cool, and cooling coils to cool the exterior air before sending the newly conditioned air at a certain temperature and humidity into the spray booth. This is a significant task since typical high production-volume vehicle spray booths require over 100,000 cubic feet per minute of airflow in order for painting to safely and properly occur.

To accomplish this, the known systems utilize a reactive control system in which outside weather data is collected by sensors at the inlet of the conditioning system in real time. Then, PLCs (programmable logic controllers) using PID (proportional-integral-derivative) control algorithms, determine the proper settings for the conditioning system to adjust the exterior air to a desired set point.

The set point has a specific dry-bulb temperature and relative humidity. The dry-bulb temperature is the temperature of air measured by a thermometer exposed to the air and shielded from radiation and moisture. The relative humidity is the ratio of the amount of water vapor in the air and the maximum amount of water vapor the air can hold at the same temperature.

A set point of a specific dry-bulb temperature and relative humidity can be located on a psychrometric chart. The psychrometric chart is a graph of the physical properties of the air at a constant pressure. The psychrometric chart relates various properties of the air, such as dry-bulb temperature, wet-bulb temperature, dew point temperature, relative humidity, humidity ratio, specific enthalpy, and specific volume. At a specific elevation, all of the properties of the air can be determined by initially knowing only two of the properties. Preferably, the data that makes up the psychrometric chart is stored in a lookup table in the controller, thereby simplifying control of the conditioning system.

These known systems do not account for what would be the most economical or the most energy efficient method to adjust the exterior air to the set point. Further, the set point is traditionally fixed within a predetermined range and does not change within the range depending on the condition of the exterior air. Nor do the known systems condition the exterior air based upon predicted future conditions of the exterior air. Accordingly, considerable room still exists in the technology to provide such a system that can achieve the desired results using less energy and/or costing less money to operate.

Therefore, there exists a need in the art for a method to better condition the exterior air that is used in the spray booth.

SUMMARY OF THE INVENTION

The present invention is directed toward a method and apparatus to condition exterior air for a spray booth, and in particular, spray booths for vehicles, in which the cost and/or the amount of energy consumed to condition the exterior air are used to determine a set point within a predetermined range.

More specifically, the present invention is directed toward a conditioning system in which the exterior air is adjusted to a variable set point within a predetermined range. Variable set point selection is based upon traditional considerations for selecting a set point, such as maintaining safe conditions in the spray booth and minimizing quality defects in the paint on the vehicle. However, the variable set point selection of the present invention is also concerned with selecting a set point that uses the least amount of energy and/or that costs the least amount of money to condition the exterior air. In addition, the present invention optionally also considers selecting the variable set point based upon predicted future weather conditions. For example, less energy may be consumed or it may cost less for a variable set point to be selected on the basis of the predicted future weather conditions, rather than selecting a set point for the immediate weather conditions.

In accordance with the present invention, a controller utilizes outside weather data, such as dry-bulb temperature and relative humidity measurements of the exterior air, along with a mathematical profile of weather data, to determine settings for the conditioning system. These settings are either the most economical and/or the most energy efficient. The mathematical profile is based upon previous weather conditions and weather trends in a localized domain, where the localized domain is an area immediately surrounding a manufacturing plant that includes a booth area.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
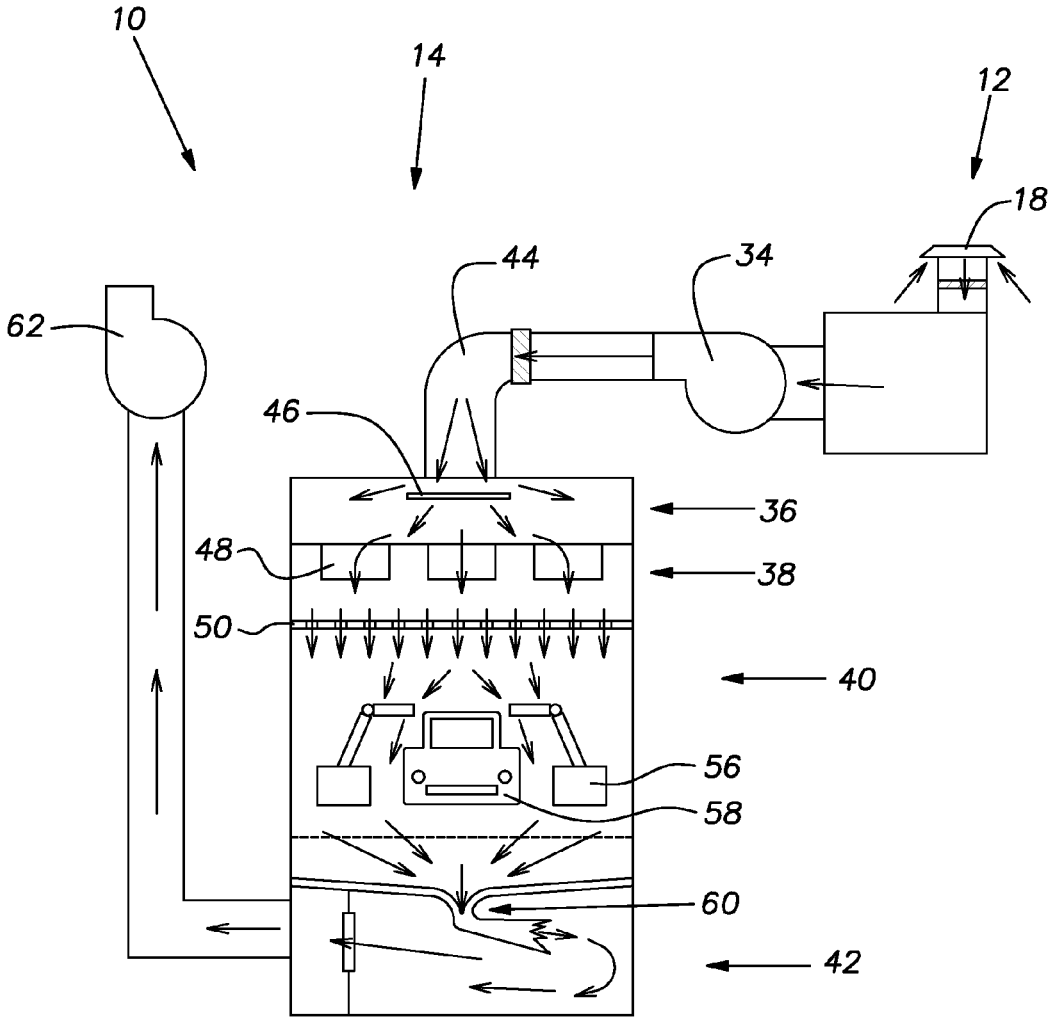
FIG. 1 is a front sectional view of a spray booth conditioning system.
Figure 2:
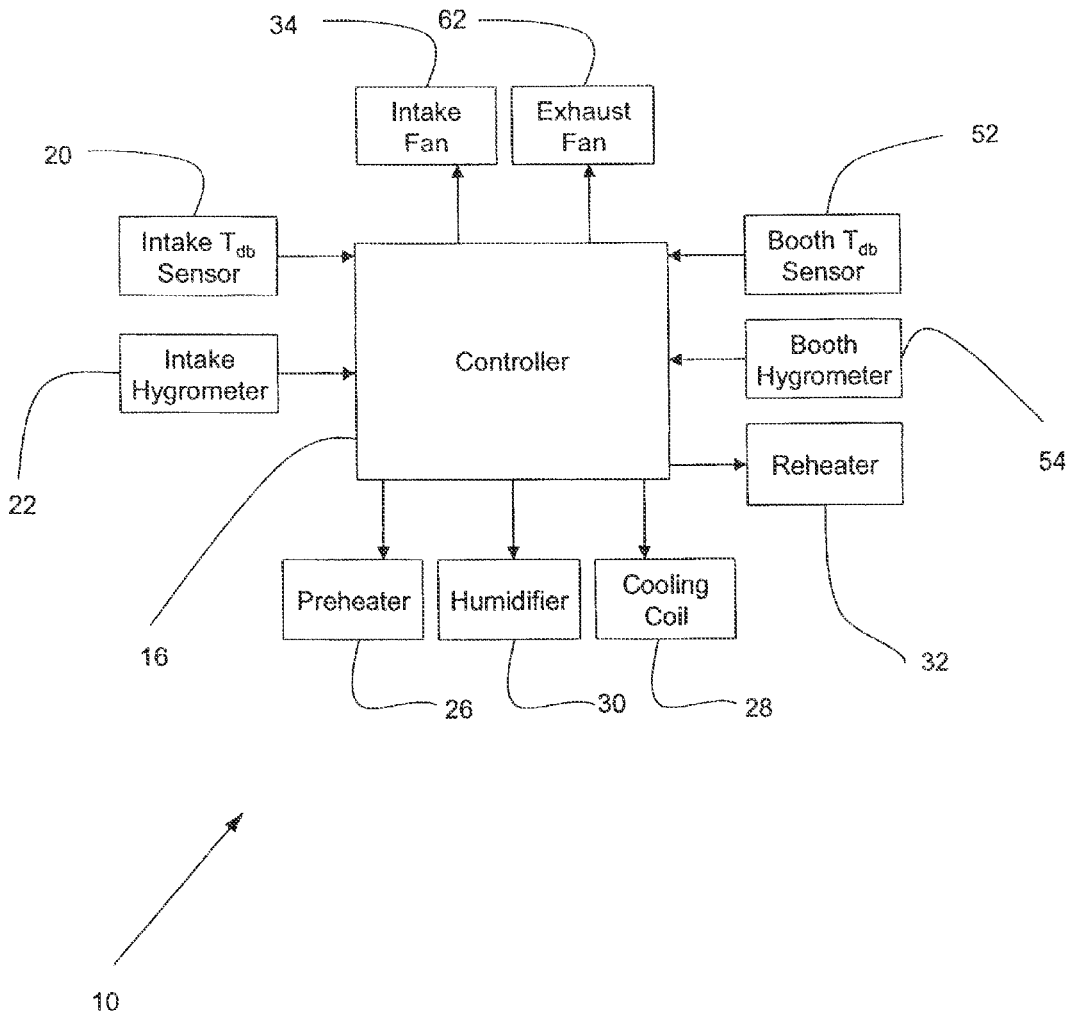
FIG. 2 is a schematic diagram illustrating the relationship between various components of the conditioning system of the present invention.
Figure 3:
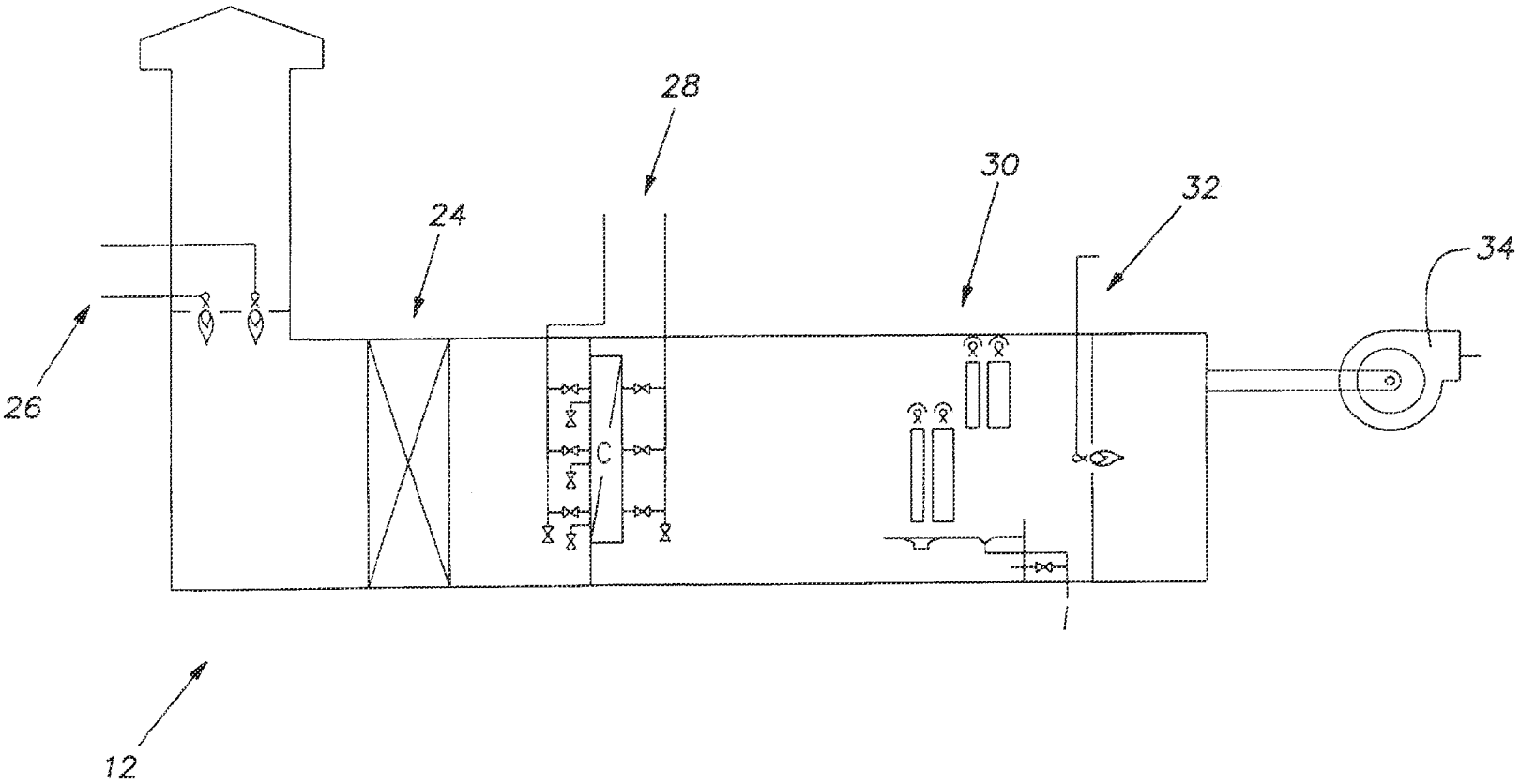
FIG. 3 is a side sectional view of a conditioning area.

With reference to FIGS. 1-3, a conditioning system 10 for air used during the spray painting of vehicles according to the present invention is shown. A conditioning area 12 and a booth area 14 make up the conditioning system 10. The conditioning area 12 includes a controller 16, an inlet 18, an intake temperature sensor 20, an intake hygrometer 22, a first set of filters 24, a preheater 26, a cooling coil 28, a humidifier 30, a reheater 32, and an intake fan 34.

The booth area 14 is divided into an upper plenum 36, a lower plenum 38, a spray area 40, and a lower area 42. The upper plenum 36 includes an inlet tap 44 and a diffuser plate 46, while the lower plenum 38 includes a second set of filters 48 and a ceiling filter 50. The upper plenum 36 further contains a booth temperature sensor 52 and a booth hygrometer 54. The spray area 40 contains spray equipment 56 for applying paint or coatings to an object, which in this case is a vehicle 58. Below the spray area 40 are scrubbers 60 and an exhaust fan 62.

The conditioning area 12 is typically located above the booth area 14, and many times, the inlet 18 is situated on a building rooftop. However, the location of the conditioning area 12 is not of specific importance. Rather, access to large amounts of air is of primary importance.

As is specifically shown in FIG. 2, the intake temperature sensor 20, the intake hygrometer 22, the preheater 26, the cooling coil 28, the humidifier 30, the reheater 32, the intake fan 34, the booth temperature sensor 52, the booth hygrometer 54, and the exhaust fan 62 are electrically connected to the controller 16. However, other means, such as wireless or fiber-optic communication means to connect the components 20, 22, 26, 28, 30, 32, 34, 52, 54, 62 with the controller 16, are possible and contemplated.

It is noted that while FIG. 2 illustrates that the preheater 26, the cooling coil 28, the humidifier 30, and the reheater 32 are connected to the controller 16, it is understood that rather, the preheater 26, the cooling coil 28, the humidifier 30, and the reheater 32 are connected to actuators and control valves, which are in turn, connected to the controller 16. The actuators and control valves are not central to the invention and as such are not illustrated.

The intake temperature sensor 20 measures the temperature of the exterior air as the exterior air enters the inlet 18 and this information is sent to the controller 16. In addition, the intake hygrometer 22 measures the absolute humidity of the exterior air as the exterior air enters the inlet 18. The hygrometers 22, 54, which are known in the art, also optionally sense dry-bulb temperature. The hygrometers 22, 54 operate on the principle that electrical resistance in a material varies as moisture is absorbed into the material. Thus, if the electrical resistance of the air is compared to the resistance of a current passing between two wires, the absolute humidity can be determined. The absolute humidity can then be converted to relative humidity.

Alternatively, the relative humidity can be determined by measuring the dry-bulb temperature and a wet-bulb temperature. After inputting the dry-bulb and wet-bulb temperatures into the controller 16, which in turn accesses a lookup table that is similar to a psychrometric chart, the relative humidity for the exterior air is known.

As described previously, the psychrometric chart is a graph of the physical properties of the air at a constant pressure. The psychrometric chart relates various properties of the air, such as the dry-bulb temperature, the wet-bulb temperature, dew point temperature, relative humidity, humidity ratio, specific enthalpy, and specific volume. At a specific elevation, all of the properties of the air can be determined by initially knowing only two of the properties. Preferably, all of the data from the psychrometric chart is stored in a lookup table in the controller 16.

The preheater 26 and the reheater 32 heat the exterior air and may be fired by natural gas or oil, or may use an electrical resistance heater to heat the exterior air, as is known. The preheater 26 is important in cool weather to heat the exterior air for subsequent use in the booth area 14. The reheater 32 is important in warm weather to heat the exterior air to the booth requirements after it has been cooled by the cooling coil 28.

The first set of filters 24, the second set of filters 48, and the ceiling filter 50 (collectively, the filters 24, 48, 50) are optionally provided and serve a number of purposes. For example, the filter 24 removes particles from the exterior air, while the filters 48, 50 remove particulates from the conditioned air. The material of the filters 24, 48, 50 may be of the various types as is known in the art.

The cooling coil 28 adjusts the temperature and humidity of the exterior air. The cooling coil 28 may be operated to remove excess water from the exterior air as required in response to a signal produced by the temperature sensor 20. Preferably, the cooling coil 28 is composed of metal tubing to provide better heat transfer between the exterior air and a coolant/refrigerant fluid that is flowing inside of the cooling coil 28. More preferably, the cooling coil 28 is composed of copper tubing.

The humidifier 30 includes a plurality of nozzles (not shown) which face into the stream of the incoming exterior air. The disposition of the nozzles in this position assures more complete evaporation of water entering the system 10, thus leading to better humidification of the exterior air being conditioned. However, other types of humidifiers could be used and the present invention is not restricted to the humidifier 30 explained herein.

The intake and exhaust fans 34, 62 are high capacity variable speed type fans, as is known in the art.

FIG. 3 illustrates the conditioning area 12. In a winter mode of operation, first the preheater 26 warms the exterior air. Then, the exterior air passes through the first set of filters 24. Then, the humidifier 30 adjusts the absolute/relative humidity of the exterior air.

In a summer mode of operation, the exterior air first passes through the first set of filters 24. Then, the cooling coil 28 cools the exterior air. After passing through the cooling coil 28, the reheater 32 heats the exterior air to make final temperature adjustments to the exterior air.

In both the winter mode and summer mode of operation, after the exterior air leaves an area near the reheater 32, the exterior air passes through the intake fan 34 and is considered conditioned air. The general layout and structure of the conditioning area 12 is known in the art.

The conditioned air then enters the booth area 14 through the inlet tap 44 and passes around the diffuser plate 46 in the upper plenum 36. The diffuser plate 46 ensures that the conditioned air is evenly distributed in the upper plenum 36. The conditioned air then passes through the second set of filters 48 in the lower plenum 38 before being passed through the ceiling filter 50 and entering into the spray area 40. It is noted that the booth area 14 layout and construction is not central to the invention and any number of common booth layouts are possible and contemplated. While in the spray area 40, the conditioned air absorbs coating overspray/mist and/or dust from the spray equipment 56 for applying paint or coatings. By removing the overspray and/or dust from the spray area 40, the quality of the coating process is improved, air quality for operator inhalation is increased, and explosion risks in the spray area 40 are decreased.

The booth temperature sensor 52 and the booth hygrometer 54, which are located in the upper plenum 36 of the booth 14, sense the booth dry-bulb air temperature and absolute/relative humidity, respectively, and communicate the booth dry-bulb air temperature and absolute/relative humidity to the controller 16. Optionally, the booth hygrometer 54 can also sense the booth dry-bulb air temperature and communicate the dry-bulb temperature to the controller 16.

After the conditioned air has traveled through the spray area 40, the conditioned air then moves through the lower area 42 including the scrubbers 60. While passing through the lower area 42, the conditioned air is cleaned and contaminants that were picked up while in the spray area 40 are removed. Subsequently, the conditioned air is discharged with the exhaust fan 62.

Proper temperature and relative humidity of the conditioned air in the spray area 40 is very important for the coating operation. For example, paint viscosity depends on the temperature in the spray area 40. Further, if the relative humidity is not high enough, any sparks that occur in the spray area 40 could potentially result in an explosion. In ignitable areas, the relative humidity is desired to be at least 55%. In addition, if the relative humidity is not properly controlled, solvent used in paint/coatings may not flash-off properly and dust may not be controlled.

Figure 4:
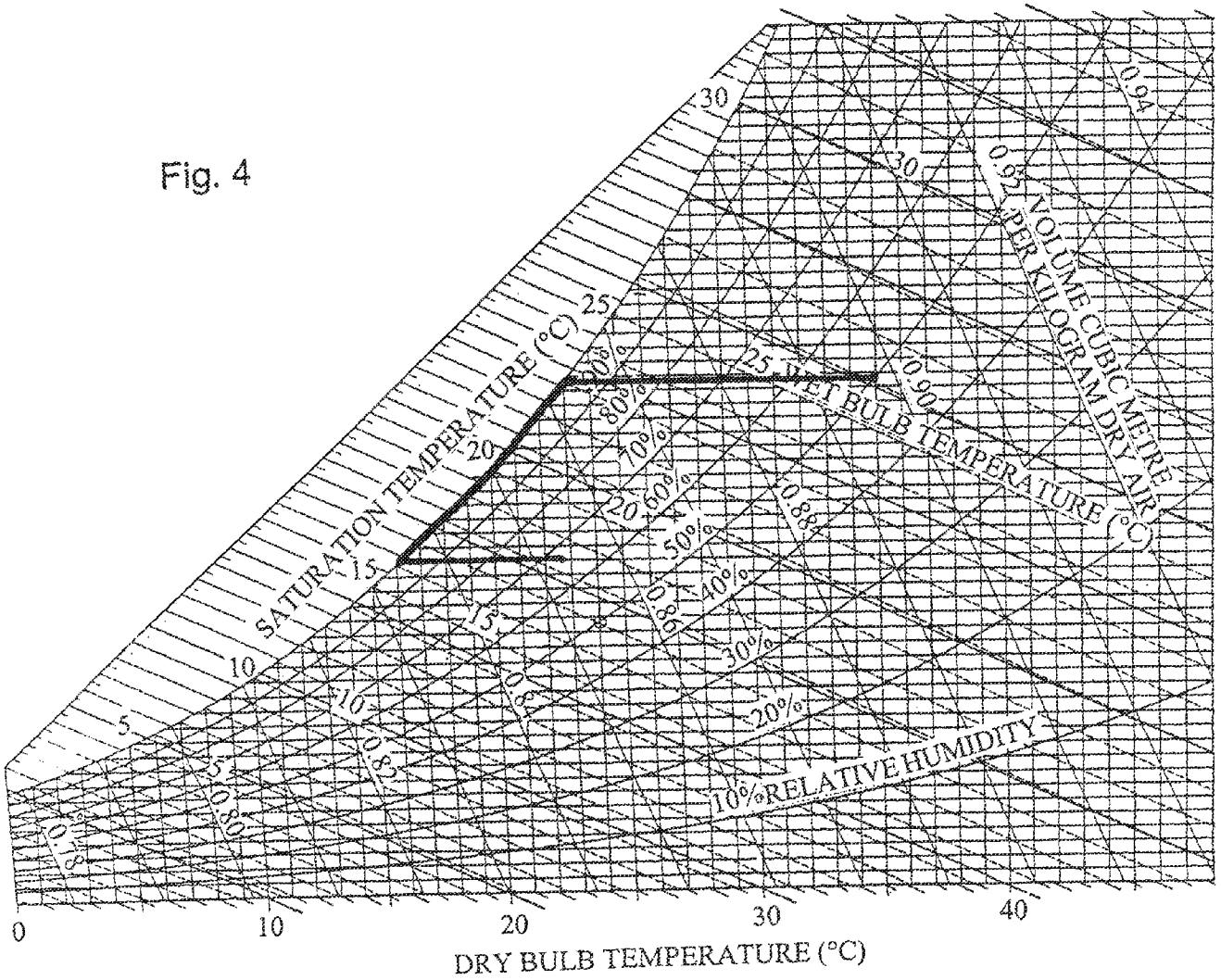
FIG. 4 is a psychrometric chart illustrating a traditional path for exterior air to be conditioned.

FIG. 4 illustrates how the traditional conditioning system would condition the exterior air as shown on the psychrometric chart. In this example, the exterior air is about 35° C. and 50% RH, which is representative of a typical summer day. The conventional conditioning system uses a traditional set point that is about 22.8° C. and 65% RH. The traditional set point is selected to be in the middle of a range of acceptable values for temperature and relative humidity. This range is based upon information provided by the suppliers of the paint used in the booth area 14. As stated hereinbefore, by conditioning the exterior air, the safety of the booth area 14 is maintained and quality defects of the painted surface of the vehicle 58 are minimized.

Figure 6:
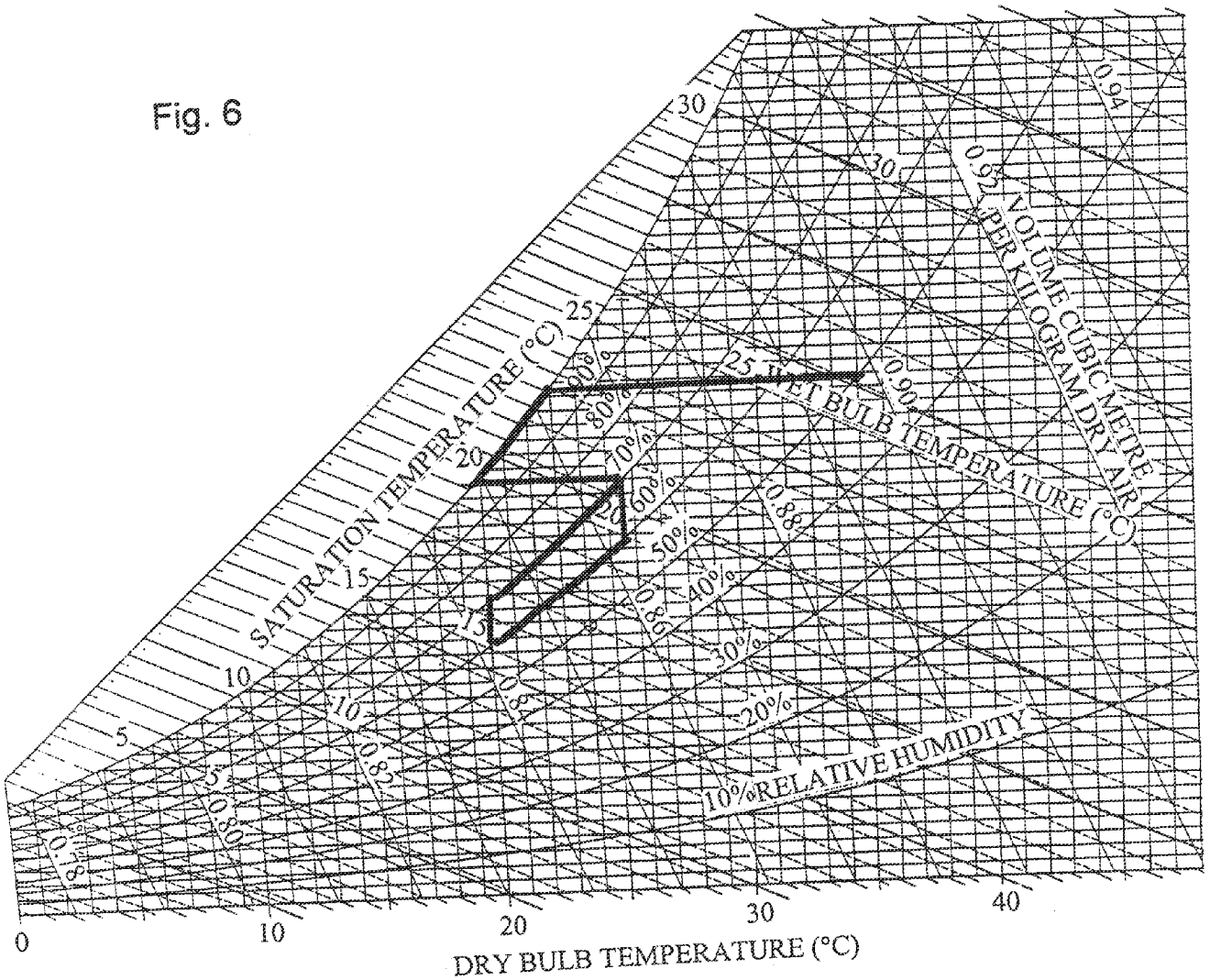
FIG. 6 is a psychrometric chart illustrating a path for the exterior air to be conditioned according to the present invention.

In the example illustrated in FIG. 4, the preheater 26 and the humidifier 30 are not activated. First, the exterior air is passed through the cooling coil 28, which cools the air to about 16° C. and 100% RH. Then, the partially conditioned air is passed through the reheater 32 to warm the partially conditioned air, resulting in conditioned air that is 22.8° C. and 65% RH as required. However, as will be evident after viewing the method of the present invention as illustrated in FIG. 6, the traditional method over-cools the exterior air. This over-cooling results in a waste of energy and money. The reason for this is that the exterior air is always conditioned to the traditional set point, instead of an alternate acceptable set point (e.g. variable set point) of the present invention.

Figure 5:
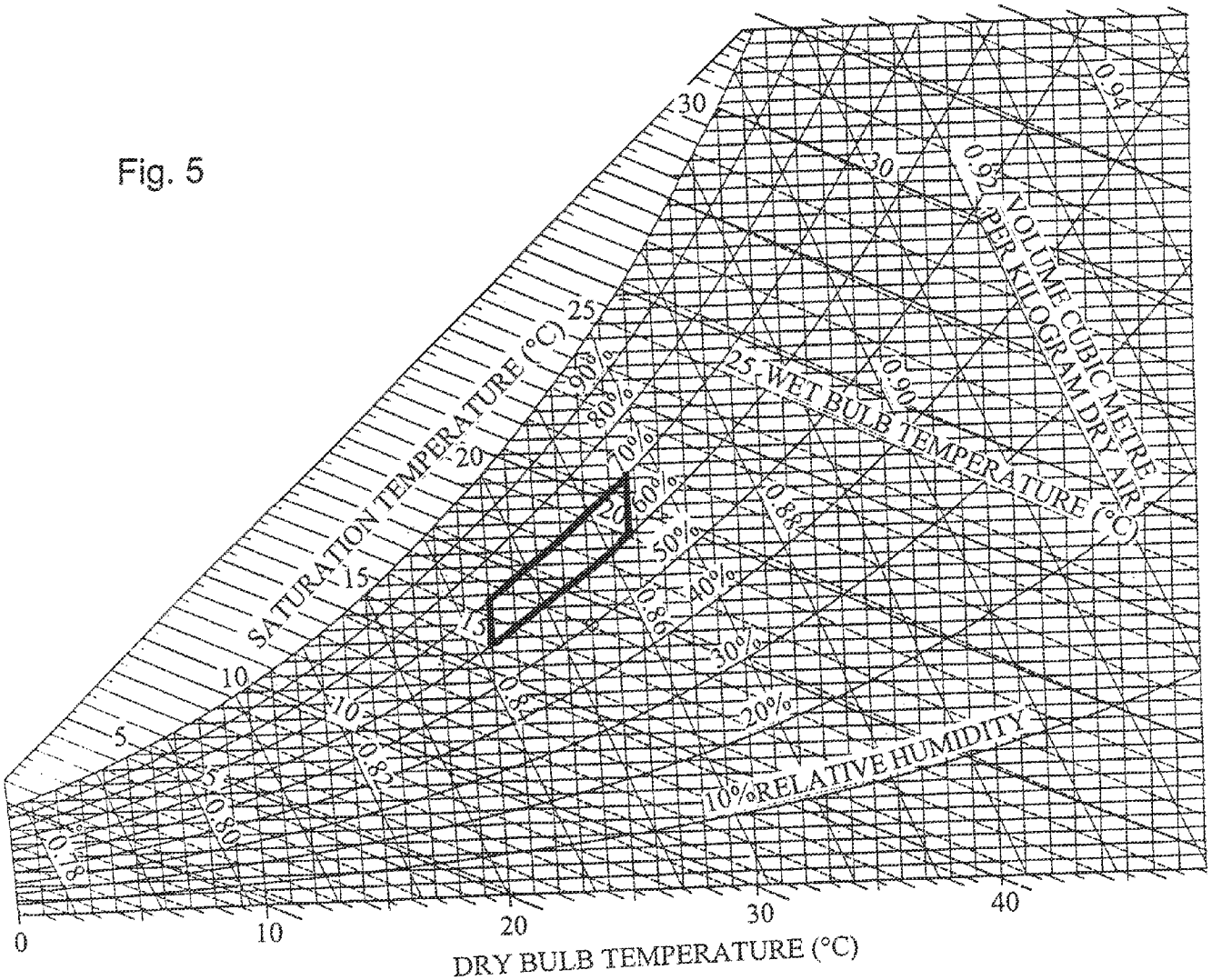
FIG. 5 is a psychrometric chart illustrating a window of acceptable values for a variable set point.

FIG. 5 illustrates acceptable values for the variable set point. In addition to the traditional set point of about 22.8° C. and 65% RH, there is a window of acceptable conditions around the 22.8° C. and 65% RH of ±2.8° C. and ±5% RH, resulting in a nearly parallelogram-shaped limit on the psychrometric chart. Alternatively, the window of acceptable conditions around the 22.8° C. and 65% RH can be ±2.8° C. and ±15% RH. However, the window of ±5% RH is preferable. As with the traditional set point, the window of acceptable conditions is provided by the paint supplier. Further, in accordance with the present invention, instead of always conditioning the exterior air to the traditional set point, the controller 16 of the present invention instructs the conditioning system 10 to adjust the exterior air to the variable set point. In the illustrated example, the variable set point is only bounded by the restrictions that the conditioned air be 22.8° C.±2.8° C. and that the relative humidity be 65% RH±5%. The controller 16 selects a variable set point that will either minimize cost or energy consumption, as will be discussed hereinafter.

FIG. 6 illustrates a path of the present invention conditioning the exterior air as shown on the psychrometric chart. The exterior air is at the same condition as the exterior air in FIG. 4. However, since the present invention conditions the exterior air to the variable set point of about 25.6° C. and 70% RH, instead of to the traditional set point of 22.8° C. and 65% RH, energy and money are saved. This is because the exterior air does not have to be cooled as much to reach the variable set point, as compared to the traditional set point.

Figure 7:
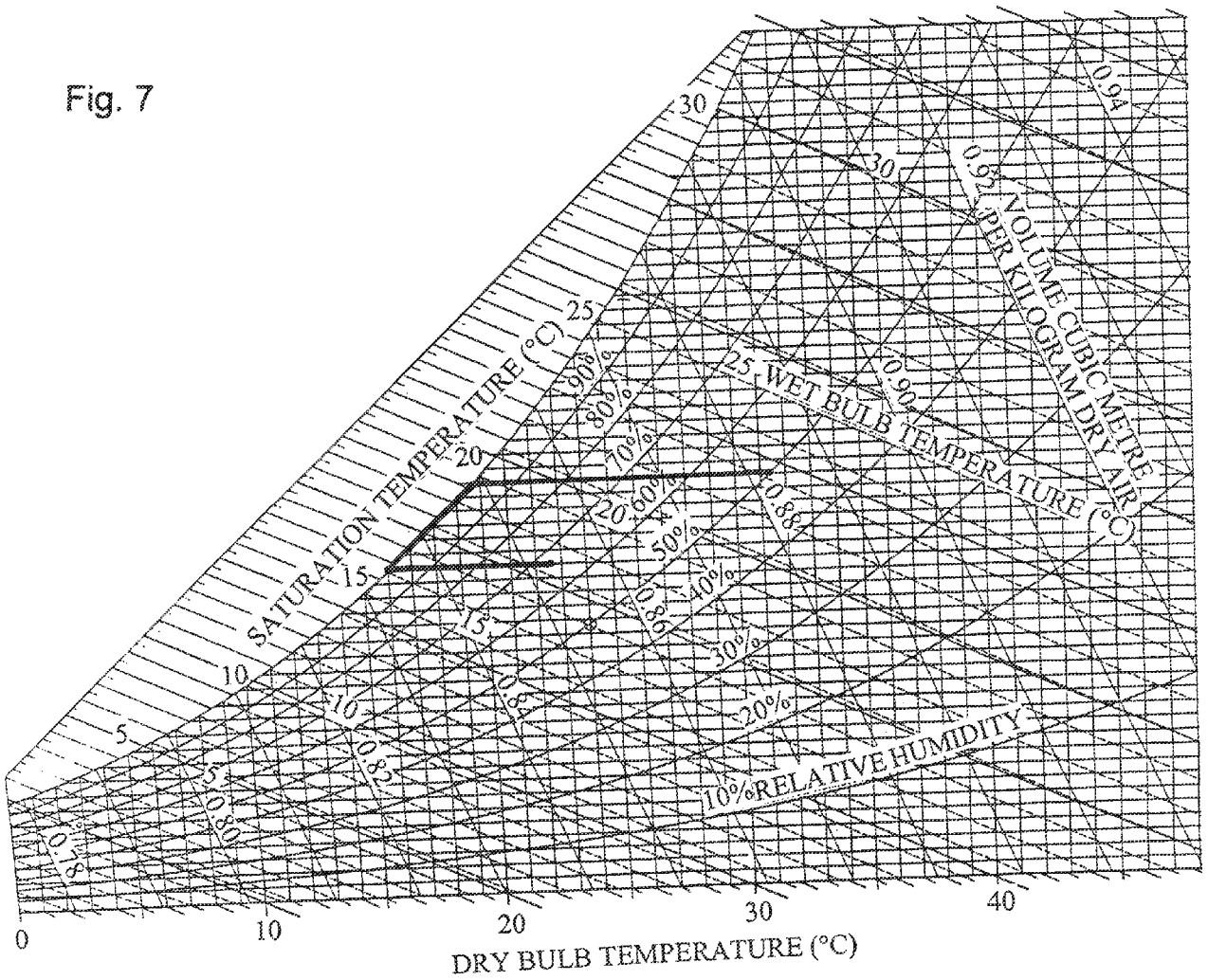
FIG. 7 is a psychrometric chart illustrating an alternate traditional path for the exterior air to be conditioned.
Figure 8:
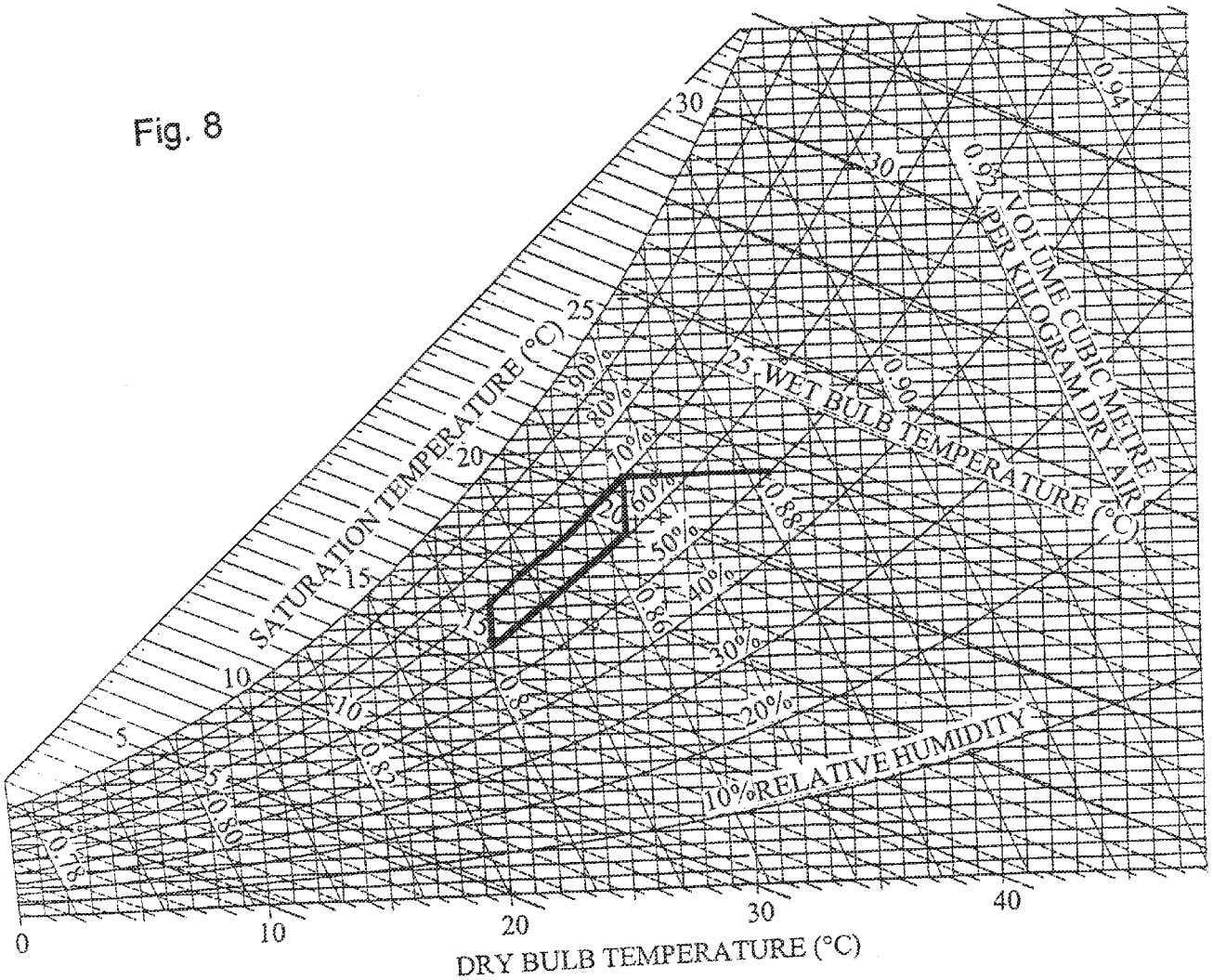
FIG. 8 is a psychrometric chart illustrating an alternate path for the exterior air to be conditioned according to the present invention.

FIGS. 7 and 8 provide an additional comparison of the conditioning paths to the traditional set point and the variable set point. In this example comparison, the exterior air is about 31.3° C. and 50% RH. As is shown in FIG. 7, the conventional conditioning system would condition the exterior air by cooling the exterior air to 16° C. and 100% RH and then heat the exterior air to the traditional set point of 22.8° C. and 65% RH. However, as is shown in FIG. 8, the present invention conditions the exterior air by merely cooling the exterior air to about 25.6° C. and 70% RH. While the two examples in FIGS. 6 and 8 have resulted in the variable set point being equal to about 25.6° C. and 70% RH, other locations on or within the window of acceptable conditions, as shown in FIG. 5, are possible and contemplated.

Selection of the variable set point may be based upon minimizing energy consumption. For example, less total energy may be consumed by conditioning the exterior air to a set point that is closer to the conditions of the exterior air than by conditioning the exterior air to the traditional set point. The previous method of conditioning the exterior air always conditioned the exterior air to the same fixed set point. There was no consideration of conditioning the exterior air to a point on the psychrometric chart that was closer to the conditions of the exterior air. Instead, the previous method would rotely condition the exterior air to the fixed set point with no consideration of the current state of the exterior air. Nor would the conventional method be concerned with which set point would result in the least amount energy being consumed.

Alternatively, selection of the variable set point may be based upon minimizing cost. This can be accomplished by either selecting a set point that is nearest to the conditions of the exterior air, and thus uses less energy, or by selecting a set point that minimizes the use of certain forms of energy that are deemed expensive. As the process for selecting a set point that is nearest to the conditions of the exterior air is the same as the process for energy minimization discussed hereinbefore, the following discussion will focus on minimizing the use of certain forms of energy that are deemed expensive.

Less money may be expended by conditioning the exterior air to a different variable set point that uses more energy, but due to the different prices of different forms of energy, is more cost effective. As stated hereinbefore, the traditional method of conditioning the exterior air always conditioned the exterior air to the same set point. There was no consideration of conditioning the exterior air to a point on the psychrometric chart that was closer to the conditions of the exterior air. For example, as different types of energy have different unit costs, it is considered clear that there may be times that to save the most amount of money, the exterior air may be conditioned in a manner that results in a larger consumption of energy.

Additionally, costs for energy can vary throughout the day. To ensure that the peak demand for the energy is not greater than the available supply, utility companies may charge different rates for the selected energy type depending upon the time of the day that the energy is used. For example, electrical utility companies may charge a premium for electricity used during peak times. As such, it is advantageous that the controller 16 associates the different costs of the various type of energy with the coinciding different times of the day. This ensures that the controller 16 selects the most cost efficient set point, even if different types of energy have variable prices.

Optionally, either of the energy saving or cost saving rationales can be applied with an understanding of the predicted future weather conditions. As mentioned hereinbefore, the present invention utilizes a mathematical profile of weather data based upon previous weather conditions and weather trends in a localized domain. The localized domain is a geographic area immediately surrounding a manufacturing plant that includes a booth area 14.

Specifically, the weather conditions are made up of two variables: the dry-bulb temperature and the relative humidity of the exterior air. Each variable is predicted in the form of a dynamic system finite difference equation:

$$X_{n+1}-X_n=f(X_n)-X_n$$

where the condition at time $t_{n+1}$ is a function of the condition at time $t_n$. The condition at time $t_{n+1}$ is determined by first piece-wise interpolating the condition data points archived in a preset interval in the controller 16 and then extrapolating it over a preset time interval. The preset time interval is typically 15 to 60 minutes. The predicted variable is constantly corrected/updated by determining the error by a first order differential equation modeled as the weighted sum of the deviations of the variables between the original forecast and the condition at the new time $t_n$. The model velocity error is integrated forward in time to determine the actual prediction error. The predicted variables from the dynamic system finite difference equation are then fed forward to the controller 16 for appropriate control of the conditioning system 10.

Accordingly, based upon the predicted future weather conditions, the controller 16 may determine that it is more advantageous to condition the exterior air to a different set point that would more closely match the predicted future weather conditions. While this decision may initially use more energy, it may require less energy overall since the system 10 will not have to repeatedly change operating conditions as the future weather conditions change.

Figure 9:
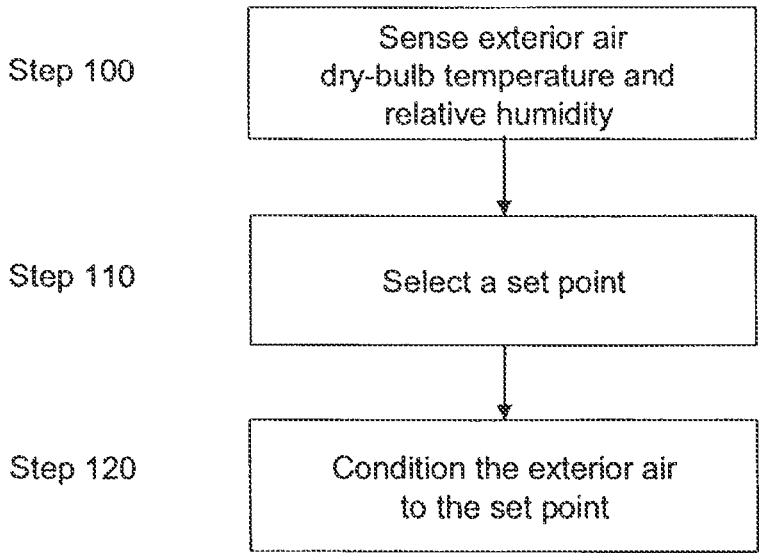
FIG. 9 is a flowchart illustrating a method according to the present invention.

A method of using the present invention is illustrated in FIG. 9. In Step 100, the exterior air dry-bulb temperature and relative humidity are sensed. Then, in Step 110, the variable set point is determined and selected by the controller 16. As discussed hereinbefore, the variable set point is determined and selected based upon which set point would result in the least amount of energy being consumed or would be the most economical to reach. Additionally, this analysis can be based upon previous weather conditions and weather trends in the localized domain.

In order to accomplish Step 110, the controller 16 calculates the energy needed to condition the exterior air to a variety of set points that are on or within the window of acceptable conditions. Then, if the exterior air is to be conditioned with a goal of minimizing energy usage, the set point that is determined to consume the least amount of energy is selected. Alternatively, if the exterior air is to be conditioned with a goal of cost minimization, the controller 16 estimates the cost associated with the variety of set points and the set point that costs the least is selected. This is possible because the controller 16 stores the costs of the different types of energy. Optionally, these costs reflect the potential variable energy rates as discussed hereinbefore. As previously stated, the controller 16 stores the costs of the various types of energy, and therefore can select the most cost effective set point. In the event that energy prices vary depending on the time of day, operation of the system 10 can still occur with a minimization of cost. In Step 120, the exterior air is conditioned based on the selected set point.

As is considered apparent, supplying properly conditioned air to the spray area 40 is very important. At the same time, conditioning the exterior air is a very expensive and energy intensive process. Accordingly, the present invention addresses these issues with the variable set point. The conditioning system 10 of the present invention is not required to adjust the exterior air to the fixed traditional set point. Rather, the exterior air can be conditioned to a specific temperature and relative humidity that satisfies all of the air quality requirements, but uses less energy and/or costs less than if the exterior air was conditioned to the traditional set point.

Sometimes a set point that consumes the least amount of energy is not the most cost effective set point to which to condition the exterior air. Accordingly, the present invention provides that the controller 16 can determine and select either the most energy efficient set point and/or the most economical set point. For example, the controller 16 may determine that the least amount of energy would be consumed by conditioning the exterior air to a variable set point that uses more natural gas to operate the preheater 26, but less electricity to operate the cooling coil 28. This selection of the variable set point would result in a lower overall consumption of energy than if the exterior air was always conditioned to the traditional set point.

Alternatively, the present invention can determine and select a variable set point that is the most economical. As is many times the case, different forms of energy cost different amounts of money. Furthermore, the energy type may have a different unit price, depending on the time of consumption. For example, the natural gas used to operate the preheater 26 may be less expensive per energy unit than the electricity that is used to operate the cooling coil 28. Also for example, the electricity used to operate the cooling coil 28 may cost more or less at different times of the day. Based upon the relative costs of the types of energy that are used to condition the exterior air, a variable set point may be selected that utilizes the most economical form of energy at the time. The present invention teaches that the variable set point may be selected based upon minimizing energy consumption and/or minimizing the total cost to condition the exterior air.

While the present disclosure has described the conditioning system 10 for spray painting vehicles, it is understood that the conditioning system 10 could be used to paint other objects, such as appliances or children's toys. Furthermore, the conditioning system 10 could alternatively be used with a coating booth for applying coatings, as opposed to the spray booth for spraying paint.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A method for conditioning exterior air for a spray booth, comprising the steps of:

sensing dry-bulb temperature of the exterior air over time;

sensing relative humidity of the exterior air over time;

selecting a set point that has a particular dry-bulb temperature and particular relative humidity, wherein selecting said set point is based upon minimizing an amount of energy required to condition the exterior air, the particular dry-bulb temperature and relative humidity of the set point being future dry-bulb temperature and relative humidity predicted by interpolating data on the previously sensed dry-bulb temperature and the previously sensed relative humidity of the exterior air in a localized domain immediately surrounding a manufacturing plant including the spray booth, and extrapolating the interpolated data; and conditioning the exterior air to the set point.

2. The method for conditioning the exterior air for the spray booth according to claim 1, wherein the particular dry-bulb temperature falls within a predetermined range of temperatures.

3. The method for conditioning the exterior air for the spray booth according to claim 2, wherein the dry-bulb temperature is between about 20° C. and 25.6° C.

4. The method for conditioning the exterior air for the spray booth according to claim 2, wherein the particular relative humidity falls within a predetermined range of relative humidities.

5. The method for conditioning exterior air for the spray booth according to claim 4, wherein the particular relative humidity is between about 50% and 80%.

6. The method for conditioning the exterior air for the spray booth according to claim 4, wherein the particular relative humidity is between about 60% and 70%.

7. The method for conditioning the exterior air for the spray booth according to claim 1, also including the step of: supplying the conditioned exterior air to a spray area of a spray booth.

8. A method for conditioning exterior air for a spray booth, comprising the steps of:

sensing dry-bulb temperature of the exterior air;

sensing relative humidity of the exterior air;

estimating an amount of consumption of energy including natural gas and electricity required to condition the exterior air to a variety of set points based upon the sensed dry-bulb temperature and the sensed relative humidity, and a cost of the energy required to condition the exterior air to the variety of set points, the variety of set points each having a particular dry-bulb temperature and relative humidity;

selecting, from the variety of set points including a set point minimizing the amount of consumption of the energy and a set point minimizing the cost of the energy, the set point that minimizes the cost of the energy; and conditioning the exterior air to the set point minimizing the cost of the energy.

9. The method for conditioning the exterior air for the spray booth according to claim 8, wherein the set point minimizing the cost of the energy is a set point having future dry-bulb temperature and relative humidity predicted by interpolating data on previous dry-bulb temperature and relative humidity of an exterior air in a localized domain immediately surrounding a manufacturing plant including the spray booth and extrapolating the interpolated data.

10. The method for conditioning the exterior air for the spray booth according to claim 8, wherein the particular dry-bulb temperature falls within a predetermined range of temperatures.

11. The method for conditioning the exterior air for the spray booth according to claim 10, wherein the predetermined temperature is between about 20° C. and 25.6° C.

12. The method for conditioning the exterior air for the spray booth according to claim 10, wherein the particular relative humidity falls within a predetermined range of relative humidities.

13. The method for conditioning the exterior air for the spray booth according to claim 12, wherein the particular relative humidity is between about 50% and 80%.

14. The method for conditioning the exterior air for the spray booth according to claim 12, wherein the particular relative humidity is between about 60% and 70%.

15. The method for conditioning the exterior air for the spray booth according to claim 8, also including the step of: supplying the conditioned exterior air to a spray area of a spray booth.

16. A system for conditioning exterior air for use in a spray booth, comprising:

a cooling coil that is adapted to cool the exterior air before the exterior air is communicated to the spray booth;

a preheater that is adapted to heat the exterior air before the exterior air is communicated to the spray booth;

a humidifier that is adapted to humidify the exterior air before the exterior air is communicated to the spray booth;

a reheater that is adapted to heat the exterior air before the exterior air is communicated to the spray booth; and a controller that controls operation of the cooling coil, the preheater, the humidifier, and the reheater to adjust a dry-bulb temperature and a relative humidity of the exterior air to a set point temperature and a set point humidity, respectively, wherein the set point temperature and set point humidity are future dry-bulb temperature and relative humidity predicted by interpolating data on previous dry-bulb temperature and relative humidity of an exterior air in a localized domain immediately surrounding a manufacturing plant including the spray booth and extrapolating the interpolated data, and are selected so as to reduce an amount of energy required to condition the exterior air to an acceptable condition for use in the spray booth.

17. The system for conditioning exterior air according to claim 16, wherein the selected set point temperature falls within a predetermined range of temperatures.

18. The system for conditioning exterior air according to claim 17, wherein the selected set point temperature is between about 20° C. and 25.6° C.

19. The system for conditioning exterior air according to claim 18, wherein the selected set point humidity falls within a predetermined range of humidities.

20. The system for conditioning exterior air according to claim 19, wherein the selected set point humidity is between about 50% and 80%.

21. The system for conditioning exterior air according to claim 19, wherein the selected set point humidity is between about 60% and 70%.

* * * * *